US006819295B1

(12) United States Patent
Peng et al.

(10) Patent No.: US 6,819,295 B1
(45) Date of Patent: Nov. 16, 2004

(54) DUAL FREQUENCY ANTI-JAMMING ANTENNA

(76) Inventors: Sheng Yeng Peng, 14890 Clementine Ct., Tustin, CA (US) 92780; Ruey Shi Chu, 13711 Damiar St., Cerritos, CA (US) 90703

( * ) Notice: Subject to any disclaimer, the term of this patent is extended or adjusted under 35 U.S.C. 154(b) by 0 days.

(21) Appl. No.: 10/367,141

(22) Filed: Feb. 13, 2003

(51) Int. Cl.[7] ..... H01Q 21/00; H01Q 1/48
(52) U.S. Cl. ..... 343/728; 343/845
(58) Field of Search ..... 343/725, 728, 343/769, 845, 867, 893

(56) References Cited

U.S. PATENT DOCUMENTS 5,557,293 A * 9/1996 McCoy et al. ..... 343/867
5,760,747 A * 6/1998 McCoy et al. ..... 343/728
6,339,404 B1 * 1/2002 Johnson et al. ..... 343/794
6,597,318 B1 * 7/2003 Parsche et al. ..... 343/700 MS
6,642,893 B1 * 11/2003 Hebron et al. ..... 343/702
2003/0146876 A1 * 8/2003 Greer et al. ..... 343/702

* cited by examiner

*Primary Examiner*—James Vannucci
*Assistant Examiner*—Minh Dieu A
(74) *Attorney, Agent, or Firm*—Donn K. Harms

(57) ABSTRACT

A dual frequency antenna providing nulling of adjacent radio signals. The antenna is formed on a single substrate of dielectric material and features a first antenna for a first frequency on top surface of the substrate mutually coupled to a second antenna formed for reception of a second frequency on the bottom surface of the substrate. A single antenna feed communicates through the substrate with the first antenna communicates both received frequencies to an attached device. Feeding the single antenna feed through the substrate wall inside the interior of both antenna perimeters provides for an unobstructed view above the first antenna. The nulled portion of the reception pattern may be steered by tilting the antenna.

17 Claims, 4 Drawing Sheets

DUAL FREQUENCY ANTI-JAMMING ANTENNA

FIELD OF THE INVENTION

This invention relates to antennas. More particularly it relates to antennas formed of two legs for the reception of two specific frequencies by a connected electronic device. More particularly it relates to dual frequency antennas such as L1 and L2 antennas which are formed on planar substrates, having dual frequency reception for Global Positioning Satellite receivers, and having enhanced nilling or anti-jamming characteristics.

BACKGROUND OF THE INVENTION

In the field of satellite navigation, there are currently two competing systems, the American GPS which operates on one frequency and which dominates the marketplace, and the Russian GLONASS system which operates on a completely different frequency but yields essentially the same navigation and terrestrial positioning information to users. A third system names Galileo in Europe is also being considered for deployment.

The Global Positioning System (GPS)and the Russian equivalent are worldwide radio-navigation systems formed from a constellation of 24 satellites and their ground stations. GPS uses these "man-made stars" as reference points to calculate terrestrial positions accurate to a matter of meters. In fact, with advanced forms of GPS you can make measurements to better than a centimeter. In a sense it's like giving every square foot of surface on the Earth a unique address.

With the rise of GPS technology and its benefits, GPS receivers have been miniaturized to just a few integrated circuits and so are becoming very economical. More recently, GPS is finding its way into cars, boats, planes, construction equipment, farm machinery, and even laptop computers.

The inherent problem with GPS is the strength of the signals broadcast by the orbiting satellites tends to be weak when reaching the Earth situated receivers. Consequently, such receivers are constantly subjected to accidental and intentional jamming or nulling of the received signal due to terrestrial interference from a variety of sources. Such interference can render the terrestrial positioning, mapping, and guiding capabilities of GPS receivers totally useless. This is especially true in military applications where intentional jamming of GPS signals by an enemy use high power transmitters in attempts to jam or render GPS technology inaccurate and ineffective.

In most cases intentional and accidental interference with GPS Satellite signals reaches the GPS receivers from a position on the earth adjacent to the receiver itself. Conventional dipole, stacked patch, and other conventional antennas used for GPS reception generally have a radiation gain pattern which resembles a half circle with the ground position of the receivers located substantially in the center of straight diameters side of that half circle. Consequently, interference either intentional or accidental that may be in an area nearby or adjacent to the receivers can jam it and render it inaccurate at best and potentially useless. Therefore it is highly advantageous to provide a high gain dual frequency antenna with a radiation gain pattern that essentially nulls adjacent terrestrial originating signals while rendering maximum gain from the signals in the direction of orbiting satellites. There is an unmet need for such a dual frequency antenna that is small and easily incorporated into small GPS devices, provides sufficient gain to receive sufficient Satellite signals to render the device accurate, and concurrently negates the accidental and intentionally generated interference that is generated terrestrially in adjacent locals to the receivers.

SUMMARY OF THE INVENTION

The preferred embodiments of this invention provides a dual band antenna that provides a radiation gain pattern that maximizes signal reception from orbiting satellites. Concurrently, the device forms a null to signal reception arriving from low or determined angles which might be generated intentionally or accidentally in areas on the earth located adjacent to the GPS receivers. The device features a dual element loop and meanderline design having an L1 in a pictured generally loop shape, formed on a top planar surface of a single substrate mutually coupled to a larger L2 loop antenna formed on the bottom surface of the substrate. However, a meanderline shape might also be used to reach the appropriate length for the desired frequency. A single point feed communicates with the L1 or top loop which functions substantially in the 1.575 Ghz frequency domain which is mutually coupled to the L2 or bottom loop that functions in the 1.227 Ghz area of the spectrum. In this fashion both signals are communicated to the device using the antenna through the single point feed. While the current best mode of the device is in the aforementioned frequency range, it is anticipated that any two frequencies might be received by elements of the proper length dimensions and consequently use of the disclosed device of any two frequencies is anticipated.

As formed, the omni directional dual band antenna provides excellent nulling position alignment between the L1 and L2 radiation gain patterns to negate jamming from adjacent signal sources that may be radiating terrestrially adjacent to the device. The device additionally provides a good return loss of −10 dB for both the L1 and L2 elements with improved axial ratio performance for circular polarization. Mutual coupling, or the induction of current in one element from the radiated fields of the second element, provide communication of the signal received by the L2 meanderline loop antenna to the driven L1 antenna through the substrate which positions the two meander line loops in parallel planes and approximately 0.125 inches apart in the current best mode of the device to facilitate this mutual coupling of the two loop elements. The antenna assembly works either with a ground plane formed below the L2 loop and used in combination herewith, or will work without one.

Although this invention speaks to the field of dual band GPS antennas, the unique principles disclosed in this patent will, to those skilled in the art, cover other bands and frequencies, especially those of the L-band portion of the microwave electromagnetic spectrum ranging from 1 to 2 Ghz, especially where anti-jamming is desirous, and it is appreciated that these be covered within the scope of this patent. As such those skilled in the art will appreciate that the conception upon which this disclosure is based may readily be utilized as a basis for designing of other devices, methods and systems for carrying out the several purposes of the present invention. It is important, therefore, that the claims be regarded as including such equivalent construction insofar as they do not depart from the spirit and scope of the present invention.

An object of this invention is to provide a single substrate, dual band antenna for GPS signal reception.

Another object of this invention is to provide such a GPS antenna that may be formed by two loop elements formed on opposite sides of a substrate of proper thickness to communicate through mutual coupling of the elements.

An additional object of this invention is the provision of a small and compact dual band antenna which provides limited or no low angle radiation gain coverage thereby preventing terrestrial jamming of Satellite originated signals.

A still further object of this invention is the provision of a small dual band antenna that has a directional radiation gain pattern to enable the user to steer the device away from any angle of terrestrial radiated signals that may interfere with the device.

These together with other objects and advantages which become subsequently apparent reside in the details of the construction and operation as more fully hereinafter described and claimed, reference being had to the accompanying drawings forming a part thereof, wherein like numerals refer to like parts throughout.

BRIEF DESCRIPTION OF THE DRAWINGS

The accompanying drawings, which are incorporated in and form a part of this specification, illustrate embodiments of the invention and together with the description, serve to explain the principles of this invention.

DETAILED DESCRIPTION OF THE PREFERRED EMBODIMENTS OF THE DISCLOSED DEVICE

Figure 1:
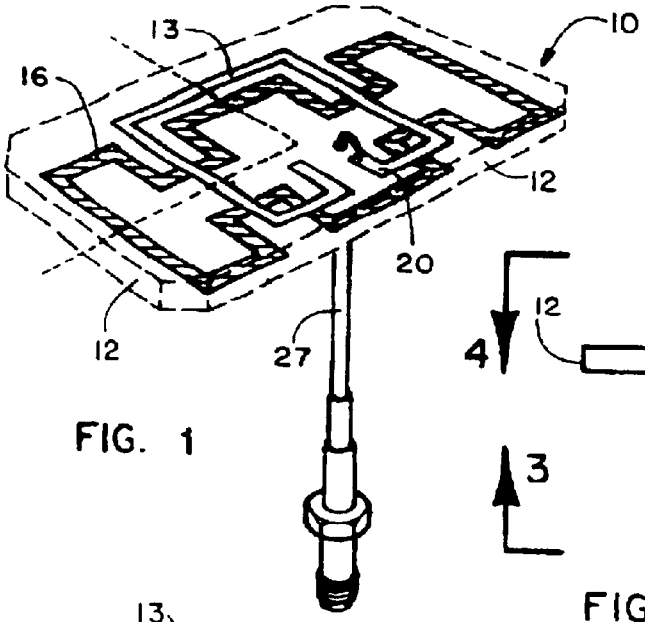
FIG. 1 depicts a perspective view of the disclosed device showing the typical mounting of the two antennas mounted on opposite sides of a dividing substrate.
Figure 2:
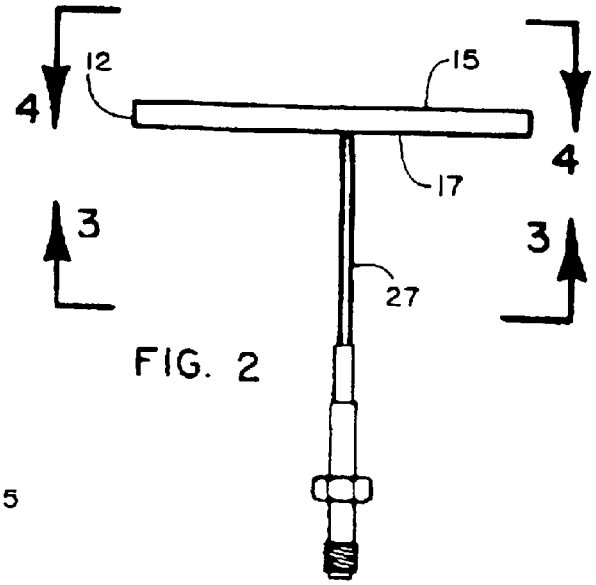
FIG. 2 shows a side view of the device in FIG. 1.

Referring now to the drawings FIGS. 1–9, wherein similar parts of the invention are identified by like reference numerals, there is seen in FIG. 1 a perspective view of the disclosed device 10 showing the two meanderline antennas in a typical configuration. The substrate 12 shown in phantom line is of a dielectric material suitable isolating the two meanderline antennas and provides a substantially flat or planar mounting surface for both antennas on opposite substantially parallel sides. The L1 antenna 13, which is pictured in a substantially loop shape, is mounted on the top surface 15 of the substrate 12. Also shown is the L2 antenna 16 which is depicted in the current best mode in a generally meanderline shape and is formed on the bottom surface 17 of the substrate 12. It should be noted that the disclosed design herein would work for many different pairs of frequencies to be received and while the current best mode is disclosed and referred to herein as a GPS L1, L2 antenna, those skilled in the art will realize that many different pairs of frequencies could be received by the device 10 by adjusting the length of the meanderline forming the individual antennas 13 and 16, and such is anticipated. Consequently the use of either a loop shaped antenna for the L1 antenna 13 or a meanderline shape would be chosen depending on the frequency desired. In the current best mode of the device, the L1 antenna 13 is loop shaped and the L2 antenna 16 is generally meanderline to reach the desired length for its frequency reception.

A single point feed 18 communicates through the substrate 12 with the L1 antenna 13 and is in electrical communication at a first end 20 and a second end 22 of the L1 antenna 13. As shown best in FIG. 5, a coaxial cable 27 is used with a center conductor 24 communicating with the first end 20, through a via 26 formed in the substrate 12 communicating between the top surface 15 and the bottom surface 17 An exterior conductor 28 electrically communicates with the second end 22 of the L1 antenna 13 by way of a ground strip 30 and a conductor 32 also through a via 26.

The current best mode of the device 10 features this configuration of the feed 18 electrically communicating through a single substrate 12 with both ends of the L1 antenna 13 through the bottom surface 17 of the substrate 12 as it saves space and positions the L1 antenna 13 operatively on the top surface 15 with no wires or other conductors above the L1 antenna 13 which could effect reception. This configuration of the single feed 18 to the device 10 also works well in that the device 10 can be placed on or adjacent to the exterior surface of the receiver using it, such as a GPS receiver, and can alleviate the need to run wires to the receiver over either of the antennas which could cause interference. This provides a dual frequency antenna on a single substrate with a single feed, aiding in the compactness of the antenna while concurrently enhancing reception qualities. Also, when so configured and attached to the surface or adjacent to the exterior of the GPS receivers, a ground plane (not shown) can easily be formed from planar conducting material under the L2 conductor 16 if desired. This configuration yields a very small footprint for the device 10, allowing it to be easily mounted to the GPS device of choice and have an unobstructed view of the sky for optimum reception and with interference from the feed 18 virtually eliminated. Of course those skilled in the art will realize that the feed 18 could be attached in other fashions by running the coaxial cable directly to the L1 antenna 13 or by using a via that communicates with the L1 antenna at the first end 24, or other manner of electrical communication, and such is anticipated. However, the current best mode is the configuration shown in FIGS. 1–5 due to the minimization of interference from the feed 18, as well as the compact single feed, single substrate, component yielded by the configuration.

Figure 4:
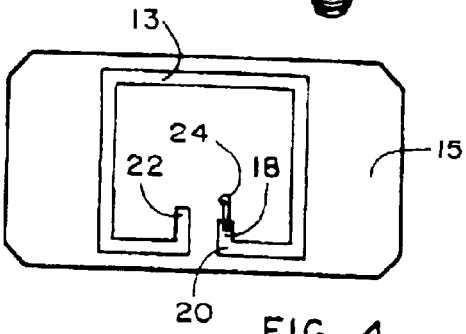
FIG. 4 is a top view of the first antenna element shown as a loop, taken along line 4—4 of FIG. 2.
Figure 3:
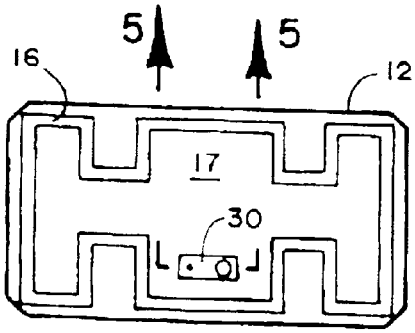
FIG. 3 is a bottom view of the device of FIG. 2, taken along line 3—3, showing the bottom meanderline shaped antenna element loop.
Figure 6:
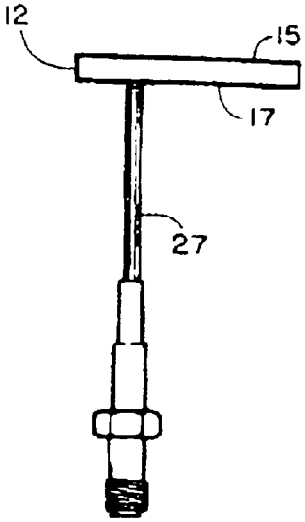
FIG. 6 is an end view of the device of FIG. 1.
Figure 5:
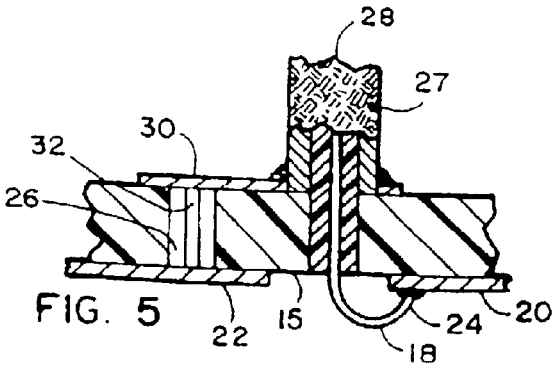
FIG. 5 depicts a side cut away view of the device showing the connection of the lead through the substrate.

The L1 antenna 13 is formed on the top surface 15 in a loop fashion, as best shown in FIG. 4, to yield the proper length for the frequency reception desired. As shown in FIG. 4 the L1 antenna 13 in the current best mode of the device 10, the antenna 13 is formed of a loop sized to a length to receive substantially in the 1.575 Ghz frequency domain. The L1 antenna 13 is mutually coupled to the parasitic L2 antenna 16 formed on the generally planar bottom surface 17. The L2 antenna 16, as shown in FIG. 3, is meanderline in nature to thereby achieve the correct length for reception of the desired frequency which in the disclosed device is substantially in the 1.227 Ghz area of the spectrum. This meanderline construction allows for achieving the proper length of the antenna leg in a very compact space.

With this unique arrangement of threading the feed 18 through the bottom surface 17 inside the perimeter of the L2 antenna 16 and using mutual coupling wherein the L2 signals are communicated through the substrate Lo the L1 antenna 13, a single point feed on a single substrate is achieved, wherein both the L1 antenna 13 signals and the L2 antenna 16 signals in their respective frequencies are communicated to the GPS or other antenna requiring component using the device 10 through the aforementioned single point feed 18. This best embodiment of the device makes it easily mountable or attachable to a plurality of different components requiring a GPS antenna. In the current best mode of the device 10 it has been found that the best mutual coupling between the L1 antenna 13 and the L2 antenna 16 is achieved when the substrate 12 has a thickness between 0.11 and 0.14 mm thereby separating both antenna legs by that determined distance with the substantially parallel top and bottom sides of the substrate maintaining the L1 and L2 antennas substantially parallel to each other. Of course those skilled in the art will realize that changing the thickness of the substrate 12 will change the mutual coupling aspects of the device 10 as well as adjusting the nulling angles and all such changes to achieve the desired mutual communication between the antennas and the desired nulling affect are anticipated.

Figure 7:
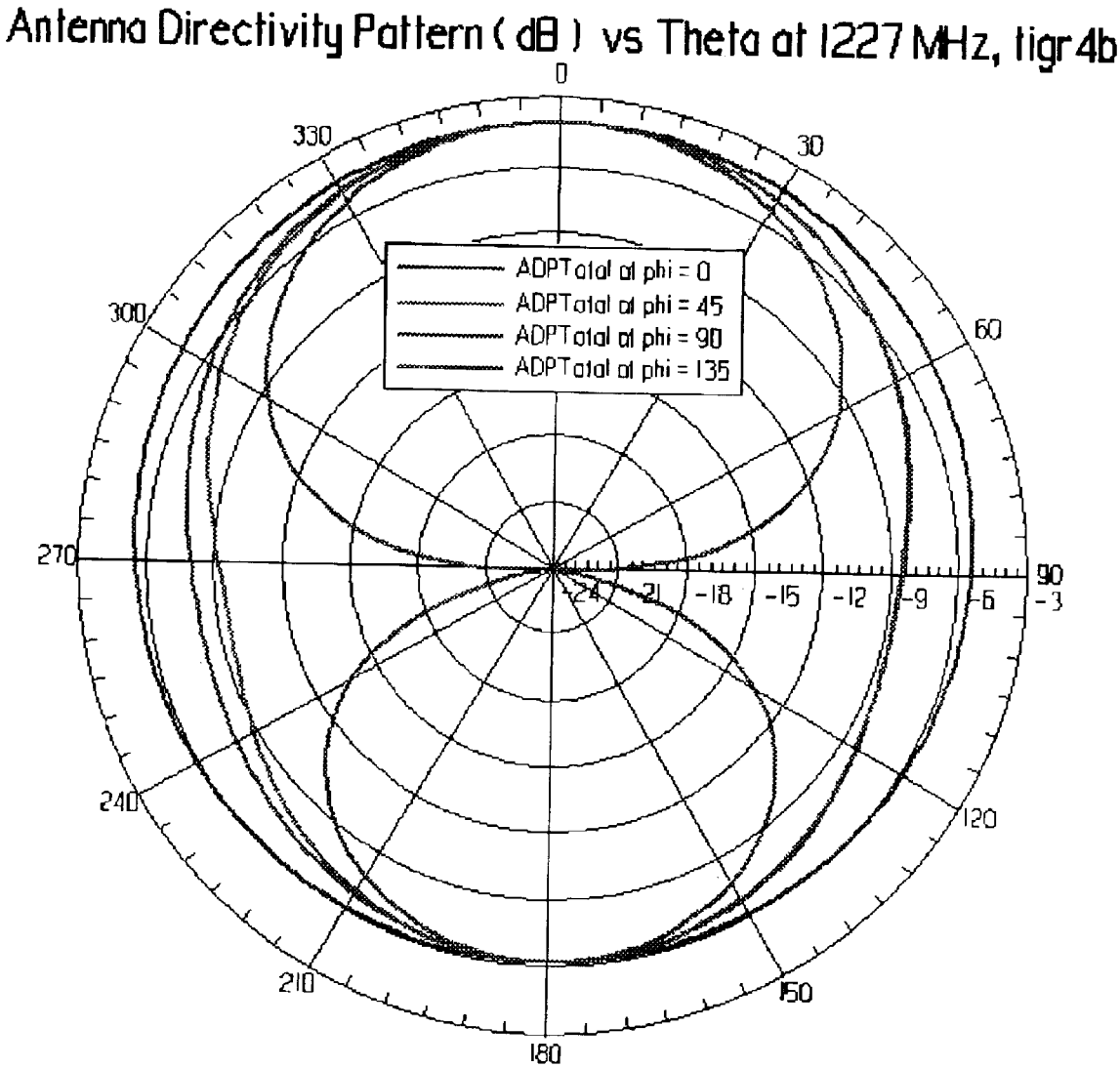
FIG. 7 depicts the radiation gain pattern developed by the disclosed device showing the nulling of coverage on a first frequency received which in this disclosure is substantially 1.227 Ghz.
Figure 8:
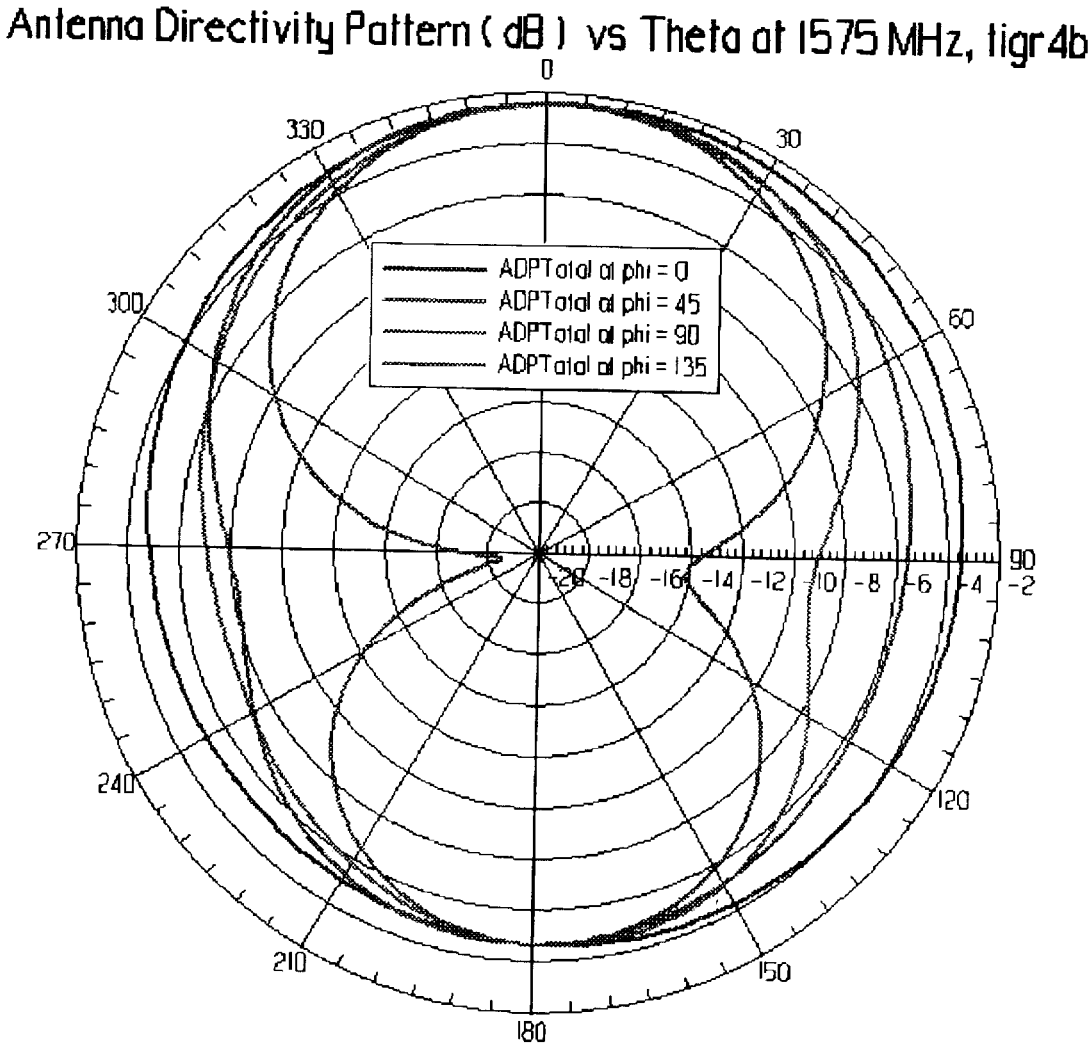
FIG. 8 depicts the radiation gain pattern developed by the disclosed device showing the nulling of coverage on a first frequency received which in this disclosure is substantially 1.575 Ghz.
Figure 9:
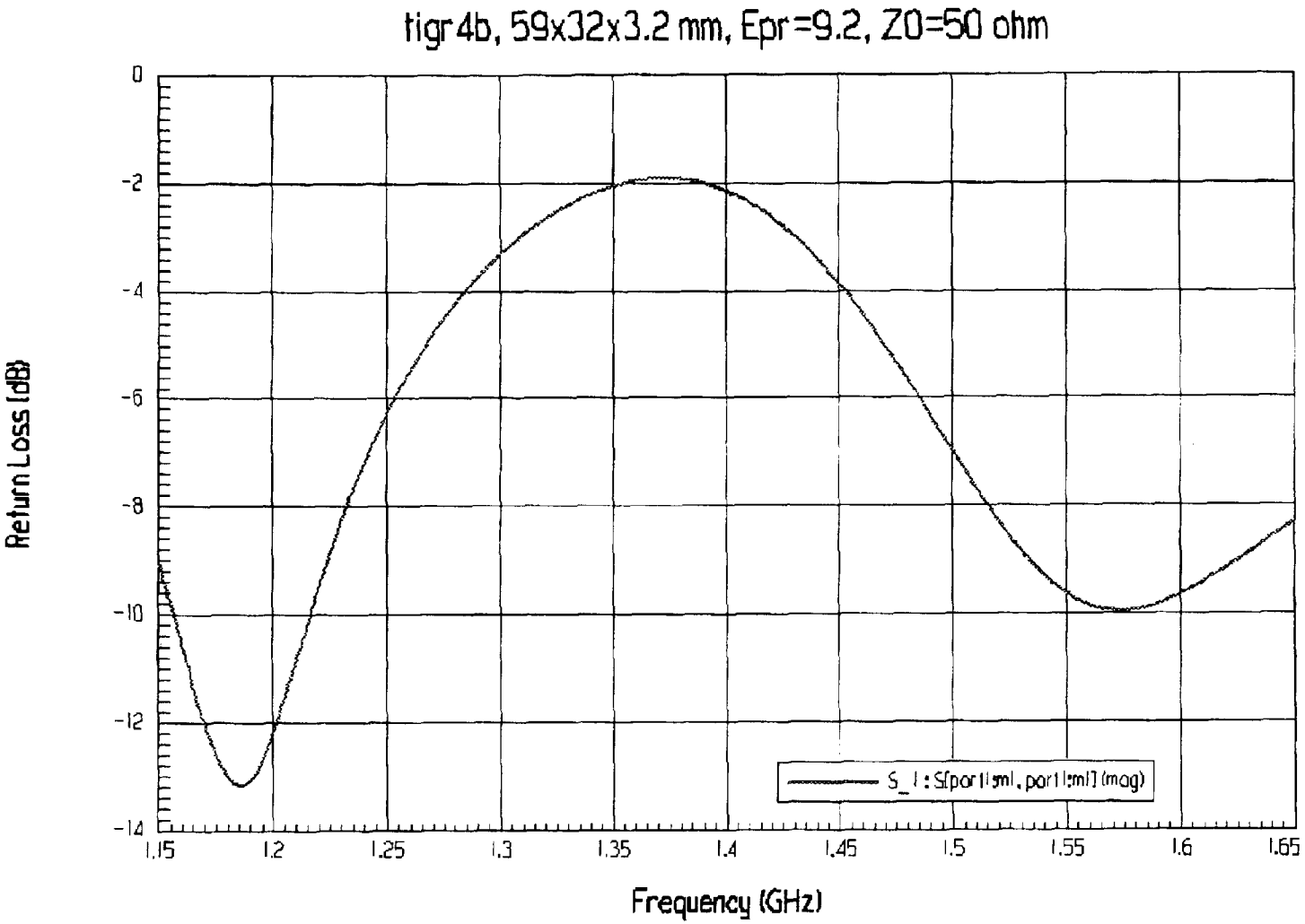
FIG. 9 is a computed graphical depiction for the return loss of the device as herein disclosed.

As best depicted in FIGS. 7–8, the device 10 in the disclosed compact configuration and with the single point feed, on a single substrate, yields an omni directional dual band antenna yields excellent nulling position alignment between the L1 and L2 radiation gain patterns. This nulling capability is especially effective to negate jamming from signal sources that may be radiating terrestrially adjacent to the device 10. This nulling may also be steered by the user by tipping the device 10 to alter the plane of the parallel top and bottom surfaces of the substrate 12 in relation to the ground or in relation to the offending signal arriving from an determined angle to steer away from reception of that signal. The device thus offers a steerable nulling capability for unwanted signals. This nulling capability is especially important in combat where the user may be subjected to jamming signals from adjacent land based transmitters such as those employed by hostile troops during wartime. Such negation of signals emanating from geographic terrestrial adjacent areas can also provide enhanced performance to navigation equipment using GPS on low flying aircraft such as airplanes or cruise missiles by allowing their guidance systems to avoid terrestrially generated jamming signals from geographically adjacent positions. Not only would the device provide nulling of unwanted signals, it also provides a steerable nulling capability as noted above. This anti-jamming capability is best shown in FIGS. 7 and 8 which depicts the reception footprint of the device 10 and shows the nulling provided by the void 34 in the reception pattern immediately adjacent to the position 0,0, on the shown grid. Further, the reception pattern of the device as herein disclosed is especially strong in the vertical direction enhancing reception from orbiting satellites which generate the L1/L2 signals received by the device 10 and used by components attached thereto.

Although the disclosed device, featuring a single point feed on a single substrate with enhanced signal anti-jamming capabilities, is described herein in the field of dual band GPS antennas, the unique configuration yielding this enhanced performance disclosed herein will, to those skilled in the art, cover other bands and frequencies, especially those of the L-band portion of the microwave electromagnetic spectrum ranging from 1 to 2 Ghz, and especially in frequency ranges where anti-jamming or nulling capability is desirous for two separate frequencies, and it is appreciated that these be covered within the scope of this parent. As such, those skilled in the art will appreciate that the conception upon which this disclosure is based may readily be utilized as a basis for designing of other devices, methods and systems for carrying out the several purposes of the present invention. It is important, therefore, that the claims be regarded as including such equivalent construction insofar as they do not depart from the spirit and scope of the present invention.

The device herein shown in the drawings and described in detail herein disclose arrangements of elements of particular construction and configuration for illustrating preferred embodiments of structure and method of operation of the present invention. It is to be understood, however, that elements of different construction and configuration and other arrangements thereof, other than those illustrated and described, may be employed for providing an antenna optimized for dual frequency reception in the L-band portion of the microwave electromagnetic spectrum ranging from 1 to 2 Ghz, and especially for reception of GPS signals while provide anti-jamming characteristics in accordance with the spirit of this invention. Further, the antennas formed may be changed to be of optimum length for reception of any two different frequencies required by an attached component. All such changes, alternations and modifications as would occur to those skilled in the art are considered to be within the scope of this invention as broadly defined in the appended claims.

As such, while the present invention has been described herein with reference to particular embodiments thereof, a latitude of modifications, various changes and substitutions are intended in the foregoing disclosure, and it will be appreciated that in some instances some features of the invention will be employed without a corresponding use of other features without departing from the scope of the invention as set forth in the following claims.

What is claimed is:

1. A dual frequency antenna comprising:

a planar dielectric substrate having a top surface and a bottom surface;

a separation between said top surface and said bottom surface defined by a thickness of said substrate;

a first antenna element on said top surface of said substrate, said first antenna element being dimensioned to a first length to receive radio transmissions at a first frequency, said first antenna element having first and second terminating ends;

a second antenna element on said bottom surface of said substrate, said second antenna element dimensioned to a second length to receive radio transmissions at a second frequency;

said second antenna element electrically communicating with said first antenna element through mutual coupling;

said second antenna being a substantially meanderline shape, said second antenna defining an interior portion of said substrate defined substantially by the perimeter of said meanderline shape;

a single point feed having a first end communicating with said first and second terminating ends of said first loop element; and a second end of said single point feed adapted for operative engagement with an electronic device, whereby said radio transmissions at said second frequency are communicated to said first antenna element from said second antenna element and said first antenna element communicates both said first frequency and said second frequency radio transmissions through said single point feed to said electronic device.

2. The dual frequency antenna of claim 1 additionally comprising:

said first antenna being shaped substantially as a loop, said loop defining an inner portion of said substrate defined substantially by the perimeter of said loop.

3. The dual frequency antenna of claim 1 additionally comprising:

said first end of said single point feed having a first conductor communicating through an aperture in said substrate, said aperture communicating from said interior portion of said bottom surface to said inner portion of said top surface, to a connection with said first terminating end of said first antenna element;

said first end of said single point feed having a second conductor communicating through a via in said substrate, said via communicating from said interior portion of said bottom surface to said inner portion of said top surface with said second terminating end of said first antenna element; and said first antenna element thereby having an unobstructed upward view.

4. The dual frequency antenna of claim 3 additionally comprising:

said first antenna element being substantially parallel to said second antenna element.

5. The dual frequency antenna of claim 1 additionally comprising:

said first antenna element being substantially parallel to said second antenna element.

6. The dual frequency antenna of claim 1 additionally comprising:

said first antenna being shaped a substantially meanderline shape, said first antenna defining an inner portion of said substrate defined substantially by the perimeter of said meanderline shape.

7. The dual frequency antenna of claim 1 additionally wherein said first frequency is substantially 1.227 Ghz and said second frequency is substantially 1.575 Ghz.

8. A dual frequency antenna comprising:

a planar dielectric substrate having a top surface and a bottom surface;

a separation between said top surface and said bottom surface defined by a thickness of said substrate;

a first antenna element on said top surface of said substrate, said first antenna element being dimensioned to a first length to receive radio transmissions at a first frequency, said first antenna element having first and second terminating ends;

a second antenna element on said bottom surface of said substrate, said second antenna element dimensioned to a second length to receive radio transmissions at a second frequency;

said second antenna element electrically communicating with said first antenna element through mutual coupling;

a single point feed having a first end communicating with said first and second terminating ends of said first loop element; and a second end of said single point feed adapted for operative engagement with an electronic device, whereby said radio transmissions at said second frequency are communicated to said first antenna element from said second antenna element and said first antenna element communicates both said first frequency and said second frequency radio transmissions through said single point feed to said electronic device;

said first end of said single point feed having a first conductor communicating through an aperture in said substrate from said bottom surface to a connection with said first terminating end of said first antenna element;

said first end of said single point feed having a second conductor electrically communicating through an aperture in said substrate with said second terminating end of said first antenna element; and said first antenna element thereby having an unobstructed upward view.

9. The dual frequency antenna of claim 8 sadditionally comprising:

said first antenna element being substantially parallel to said second antenna element.

10. The dual frequency antenna of claim 9 additionally comprising:

said second antenna being a substantially loop shape, said second antenna defining an interior portion of said substrate defined substantially by the perimeter of said loop shape.

11. The dual frequency antenna of claim 10 additionally comprising:

said first antenna being shaped a substantially meanderline shape, said loop defining an inner portion of said substrate defined substantially by the perimeter of said meanderline shape.

12. The dual frequency antenna of claim 11 additionally comprising:

said second antenna being a substantially loop shape, said second antenna defining an interior portion of said substrate defined substantially by the perimeter of said loop shape.

13. The dual frequency antenna of claim 8 additionally comprising:

said second antenna being a meanderline shape, said second antenna defining an interior portion of said substrate defined substantially by the perimeter of said meanderline shape.

14. The dual frequency antenna of claim 8 additionally comprising:

said second antenna being a substantially loop shape, said second antenna defining an interior portion of said substrate defined substantially by the perimeter of said loop shape.

15. The dual frequency antenna of claim 8 additionally comprising:

said first antenna being shaped a substantially meanderline shape, said loop defining an inner portion of said substrate defined substantially by the perimeter of said meanderline shape.

16. The dual frequency antenna of claim 15 additionally comprising:

said second antenna being a substantially loop shape, said second antenna defining an interior portion of said substrate defined substantially by the perimeter of said loop shape.

17. The dual frequency antenna of claim 8 additionally wherein said first frequency is substantially 1.227 Ghz and said second frequency is substantially 1.575 Ghz.

* * * * *